US005387574A

United States Patent [19]

Campbell et al.

[11] Patent Number: 5,387,574

[45] Date of Patent: Feb. 7, 1995

[54] RECEIVING ELEMENT FOR THERMAL DYE TRANSFER

[75] Inventors: Bruce C. Campbell; William A. Mruk, both of Rochester, N.Y.

[73] Assignee: Eastman Kodak Company, Rochester, N.Y.

[21] Appl. No.: 241,313

[22] Filed: May 10, 1994

[51] Int. Cl.[6] ..... B41M 5/035; B41M 5/38

[52] U.S. Cl. ..... 503/227; 428/195; 428/207; 428/315.5; 428/318.4; 428/318.8; 428/690; 428/910; 428/913; 428/914

[58] Field of Search ..... 8/471; 428/195, 207, 428/315.5, 318.4, 318.8, 690, 910, 913, 914; 503/227

[56] References Cited

U.S. PATENT DOCUMENTS 5,244,861 9/1993 Campbell et al. ..... 503/227

*Primary Examiner*—B. Hamilton Hess

*Attorney, Agent, or Firm*—Harold E. Cole

[57] ABSTRACT

Thermal dye transfer receiving elements are disclosed comprising a base having thereon a dye image-receiving layer, the base comprising a composite film laminated to a support, the dye image-receiving layer being on the composite film side of the base. The composite film comprises a microvoided thermoplastic core layer and at least one substantially void-free thermoplastic surface (skin) layer containing titanium dioxide in its anatase form and an optical brightener.

20 Claims, No Drawings

RECEIVING ELEMENT FOR THERMAL DYE TRANSFER

This invention relates to dye-receiving elements used in thermal dye transfer, and more particularly to a microvoided composite film used as a support for dye-receiving elements which has an improved whiteness.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye-receiving elements used in thermal dye transfer generally comprise a polymeric dye image-receiving layer coated on a base or support. In a thermal dye transfer printing process, it is desirable for the finished prints to compare favorably with color photographic prints in terms of image quality. The thermal dye receiver base must possess several characteristics for this to happen. First of all, transport through the printer is largely dependent on the base properties. The base must have low curl and a stiffness that is neither too high or too low. The base has a major impact on image quality. Image uniformity is very dependent on the conformability of the receiver base. The efficiency of thermal transfer of dye from the donor to the receiver is also impacted by the base's ability to maintain a high temperature at its surface. The look of the final print is largely dependent on the base's whiteness and surface texture. Receiver curl before and after printing must be minimized. Cellulose paper, synthetic paper, and plastic films have all been proposed for use as dye-receiving element supports in efforts to meet these requirements.

In U.S. Pat. No. 5,244,861, dye-receiving elements are disclosed wherein a dye image-receiving layer is coated onto a composite film laminated to a support. The composite film comprises a microvoided thermoplastic core layer and at least one substantially void-free thermoplastic surface layer. Several of the microvoided packaging films disclosed in this patent which are useful supports are described as having a core layer having a "white pigmented non-microvoided oriented polypropylene surface layer" on one or both sides thereof. However, there is a problem with these receivers in that the degree of whiteness could be improved which is desirable for many applications. It is an object of this invention to improve the whiteness of such composite film receivers.

These and other objects are achieved in accordance with the invention, which comprises a dye-receiving element for thermal dye transfer comprising a base having thereon a dye image-receiving layer, the base comprising a composite film laminated to a support, the dye image-receiving layer being on the composite film side of the base, the composite film comprising a microvoided thermoplastic core layer and a substantially void-free thermoplastic surface layer, the thermoplastic surface layer being adjacent to the dye image-receiving layer, and wherein the thermoplastic surface layer contains titanium dioxide in its anatase form and an optical brightener.

The anatase titanium dioxide which is in the thermoplastic surface layer may be present in any amount which is effective for the intended purpose. In general, good results have been obtained when the titanium dioxide is present in an amount of from about 0.2 $g/m^2$ to about 1.5 $g/m^2$ of the thermoplastic surface layer. Anatase titanium dioxide is commercially available such as Kronos 1072® (Kronos Inc.), Kemira 0220® (Kemira Inc.), Sachtleben LOCH-K® (Sachtleben Chemie GmbH.) and Tioxide A-HR® (Tioxide Inc.).

The optical brightener which is added to the thermoplastic surface layer may be present in any amount which is effective for the intended purpose. In general, good results have been obtained when the optical brightener is present in an amount of from about 0.0001 to about 0.01 $g/m^2$ of the thermoplastic surface layer. Any type of optical brightener can be used in the invention such as the benzoxazoles, stilbenes, coumarin and carbostyril compounds, 1,3-diphenyl-2-pyrazolines, naphthalamides, etc. Commercially available optical brighteners which are useful in the invention include Uvitex OB® (Ciba-Geigy Corp.), Eastobrite OB-1® (Eastman Chemical Co.) and Hostalux KS® (Hoechst Celanese Corp.).

It is believed that the combination of the optical brightener and the anatase titanium dioxide provides the increased whiteness which is evident from the receivers of the invention.

Due to their relatively low cost and good appearance, these composite films are generally used and referred to in the trade as "packaging films." The support may include cellulose paper, a polymeric film or a synthetic paper. A variety of dye-receiving layers may be coated on these bases.

Unlike synthetic paper materials, microvoided packaging films can be laminated to one side of most supports and still show excellent curl performance. Curl performance can be controlled by the beam strength of the support. As the thickness of a support decreases, so does the beam strength. These films can be laminated on one side of supports of fairly low thickness/beam strength and still exhibit only minimal curl.

The low specific gravity of microvoided packaging films (preferably between 0.3–0.7 $g/cm^3$) produces dye-receivers that are very conformable and results in low mottle-index valves of thermal prints as measured on an instrument such as the Tobias Mottle Tester. Mottle-index is used as a means to measure print uniformity, especially the type of non-uniformity called dropouts which manifests itself as numerous small unprinted areas. These microvoided packaging films also are very insulating and produce dye-receiver prints of high dye density at low energy levels. The nonvoided skin produces receivers of high gloss and helps to promote good contact between the dye-receiving layer and the dye-donor film. This also enhances print uniformity and efficient dye transfer.

Microvoided composite packaging films are conveniently manufactured by coextrusion of the core and surface layers, followed by biaxial orientation, whereby voids are formed around void-initiating material contained in the core layer. Such composite films are disclosed in, for example, U.S. Pat. No. 4,377,616, the disclosure of which is incorporated by reference.

The core of the composite film should be from 15 to 95% of the total thickness of the film, preferably from 30 to 85% of the total thickness. The nonvoided skin(s) should thus be from 5 to 85% of the film, preferably from 15 to 70% of the thickness. The density (specific gravity) of the composite film should be between 0.2 and 1.0 g/cm$^3$, preferably between 0.3 and 0.7 g/cm$^3$. As the core thickness becomes less than 30% or as the specific gravity is increased above 0.7 g/cm$^3$, the composite film starts to lose useful compressibility and thermal insulating properties. As the core thickness is increased above 85% or as the specific gravity becomes less than 0.3 g/cm$^3$, the composite film becomes less manufacturable due to a drop in tensile strength and it becomes more susceptible to physical damage. The total thickness of the composite film can range from 20 to 150 $\mu$m, preferably from 30 to 70 $\mu$m. Below 30 $\mu$m, the microvoided films may not be thick enough to minimize any inherent non-planarity in the support and would be more difficult to manufacture. At thicknesses higher than 70 $\mu$m, little improvement in either print uniformity or thermal efficiency are seen, and so there is little justification for the further increase in cost for extra materials.

"Void" is used herein to mean devoid of added solid and liquid matter, although it is likely the "voids" contain gas. The void-initiating particles which remain in the finished packaging film core should be from 0.1 to 10 $\mu$m in diameter, preferably round in shape, to produce voids of the desired shape and size. The size of the void is also dependent on the degree of orientation in the machine and transverse directions. Ideally, the void would assume a shape which is defined by two opposed and edge-contacting concave disks. In other words, the voids tend to have a lens-like or biconvex shape. The voids are oriented so that the two major dimensions are aligned with the machine and transverse directions of the film. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5–50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the solution is cooled down. Examples of this would include nylon dispersed in polypropylene, poly(butylene terephthalate) in polypropylene, or polypropylene dispersed in poly(ethylene terephthalate). If the polymer is preshaped and blended into the matrix polymer, the important characteristics are the size and shape of the particles. Spheres are preferred and they can be hollow or solid. These spheres may be made from cross-linked polymers which are members selected from the group consisting of an alkenylaromatic compound having the general formula Ar—C(R)=CH$_2$, wherein Ar represents an aromatic hydrocarbon radical, or an aromatic halohydrocarbon radical of the benzene series and R is hydrogen or the methyl radical; acrylate-type monomers include monomers of the formula CH$_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula CH$_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series HO(CH$_2$)$_n$OH wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the cross-linked polymer include styrene, butyl acrylate, acrylamide, acrylonitrile, methyl methacrylate, ethylene glycol dimethacrylate, vinylpyridine, vinyl acetate, methyl acrylate, vinylbenzyl chloride, vinylidene chloride, acrylic acid, divinylbenzene, acrylamidomethylpropanesulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the produced beads spanning the range of the original size distribution. Other processes such as suspension polymerization, limited coalescence, directly yield very uniformly sized particles.

The void-initiating materials may be coated with a slip agent to facilitate voiding. Suitable slip agents or lubricants include colloidal silica, colloidal alumina, and metal oxides such as tin oxide and aluminum oxide. The preferred slip agents are colloidal silica and alumina, most preferably, silica. The cross-linked polymer having a coating of slip agent may be prepared by procedures well known in the art. For example, conventional suspension polymerization processes wherein the slip agent is added to the suspension is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties.

Suitable classes of thermoplastic polymers for the core matrix-polymer of the composite film include polyolefins, polyesters, polyamides, polycarbonates, cellulosic esters, polystyrene, polyvinyl resins, polysulfonamides, polyethers, polyimides, poly(vinylidene fluoride), polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of ethylene and propylene are also useful.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, iraconic, 1,4-cyclohexanedicarboxylic, sodiosulfoisophthalic acids and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amounts of a co-acid component such as stilbene-dicarboxylic acid. Examples of such liquid crystal copolyesters are those disclosed in U.S. Pat. Nos. 4,420,607, 4,459,402 and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite films include cellulose nitrate, cellulose triacetate, cellulose diacetate, cellulose acetate propionate, cellulose acetate butyrate, and mixtures or copolymers thereof. Useful polyvinyl resins include poly(vinyl chloride), poly(vinyl acetal), and mixtures thereof. Copolymers of vinyl resins can also be utilized.

The composite film can be made with skin(s) of the same polymeric material as the core matrix, or it can be made with skin(s) of polymeric composition different from that of the core matrix. For compatibility, an auxiliary layer can be used to promote adhesion of the skin layer to the core.

Addenda may be added to the core matrix to improve the whiteness of these films. This would include any process which is known in the art including adding a white pigment, such as titanium dioxide, barium sulfate, clay, or calcium carbonate. This would also include adding optical brighteners or fluorescing agents which absorb energy in the UV region and emit light largely in the blue region, or other additives which would improve the physical properties of the film or the manufacturability of the film.

Coextrusion, quenching, orienting, and heat setting of these composite films may be effected by any process which is known in the art for producing oriented film, such as by a flat film process or by a bubble or tubular process. The flat film process involves extruding the blend through a slit die and rapidly quenching the extruded web upon a chilled casting drum so that the core matrix polymer component of the film and the skin components(s) are quenched below their glass transition temperatures (Tg). The quenched film is then biaxially oriented by stretching in mutually perpendicular directions at a temperature above the glass transition temperature of the matrix polymers and the skin polymers. The film may be stretched in one direction and then in a second direction or may be simultaneously stretched in both directions. After the film has been stretched it is heat set by heating to a temperature sufficient to crystallize the polymers while restraining the film to some degree against retraction in both directions of stretching.

These composite films may be coated or treated after the coextrusion and orienting process or between casting and full orientation with any number of coatings which may be used to improve the properties of the films including printability, to provide a vapor barrier, to make them heat sealable, or to improve the adhesion to the support or to the receiver layers. Examples of this would be acrylic coatings for printability, coating poly(vinylidene chloride) for heat seal properties, or corona discharge treatment to improve printability or adhesion.

By having at least one nonvoided skin on the microvoided core, the tensile strength of the film is increased and makes it more manufacturable. It allows the films to be made at wider widths and higher draw ratios than when films are made with all layers voided. Coextruding the layers further simplifies the manufacturing process.

The microvoided packaging films described in U.S. Pat. No. 5,244,861, modified by inclusion of anatase titanium dioxide and an optical brightener in the skin layer as described herein, are suitable for the practice of the invention when they are laminated by extrusion, pressure, or other means to a support such as polyester, paper, synthetic paper, or another microvoided film.

The support to which the microvoided composite films are laminated for the base of the dye-receiving element of the invention may be a polymeric, a synthetic paper, or a cellulose fiber paper support, or laminates thereof.

Preferred cellulose fiber paper supports include those disclosed in U.S. Pat. No. 5,250,496, the disclosure of which is incorporated by reference. When using a cellulose fiber paper support, it is preferable to extrusion laminate the microvoided composite films using a polyolefin resin. During the lamination process, it is desirable to maintain minimal tension of the microvoided packaging film in order to minimize curl in the resulting laminated receiver support. The backside of the paper support (i.e., the side opposite to the microvoided composite film and receiver layer) may also be extrusion coated with a polyolefin resin layer (e.g., from about 10 to 75 g/m$^2$), and may also include a backing layer such as those disclosed in U.S. Pat. Nos. 5,011,814 and 5,096,875, the disclosures of which are incorporated by reference. For high humidity applications (>50% RH), it is desirable to provide a backside resin coverage of from about 30 to about 75 g/m$^2$, more preferably from 35 to 50 g/m$^2$, to keep curl to a minimum.

In one preferred embodiment, in order to produce receiver elements with a desirable photographic look and feel, it is preferable to use relatively thick paper supports (e.g., at least 120 μm thick, preferably from 120 to 250 μm thick) and relatively thin microvoided composite packaging films (e.g., less than 50 μm thick, preferably from 20 to 50 μm thick, more preferably from 30 to 50 μm thick).

In another embodiment of the invention, in order to form a receiver element which resembles plain paper, e.g. for inclusion in a printed multiple page document, relatively thin paper or polymeric supports (e.g., less than 80 μm, preferably from 25 to 80 μm thick) may be used in combination with relatively thin microvoided composite packaging films (e.g., less than 50 μm thick, preferably from 20 to 50 μm thick, more preferably from 30 to 50 μm thick).

The dye image-receiving layer of the receiving elements of the invention may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657 of Harrison et at., the disclosure of which is incorporated by reference.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises image-wise heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to further illustrate the invention.

EXAMPLE

Several microvoided packaging films suitable for use in the present invention were prepared. They were 30–42 μm thick and consisted of a microvoided and oriented polypropylene core (approximately 68–84% of the total film thickness, with a non-microvoided, oriented polypropylene skin layer of 3–6 μm thickness on each side. The upper skin layer (on the side carrying the image-receiving layer) contained a benzoxazole optical brightener 0.05% wt. % (0.003 g/m$^2$) and titanium dioxide at the coverages shown in the Table for each sample. The backside skin layer contained 0.0–0.2 g/m$^2$ rutile titanium dioxide pigment. The void-initiator used was poly(butylene terephthalate).

These packaging films were extrusion-laminated as described below with pigmented polyolefin onto a paper stock support. The pigmented polyolefin was polyethylene (12 g/m$^2$) containing anatase titanium dioxide (12.5% by weight) and a benzoxazole optical brightener (0.05% by weight). The paper stock support was 137 μm thick and made from a 1:1 blend of Pontiac Maple 51 (a bleached maple hardwood kraft of 0.5 μm length weighted average fiber length), available from Consolidated Pontiac, Inc., and Alpha Hardwood Sulfite (a bleached red-alder hardwood sulfite of 0.69 μm average fiber length, available from Weyerhaeuser Paper Co.). The backside of the paper stock support was coated with high-density polyethylene (30 g/m$^2$).

Thermal dye-transfer receiving elements were prepared from the above receiver supports by coating the following layers in order on the top surface of the different laminates of microvoided films shown in the Table:

a) a subbing layer of Z-6020 (an aminoalkylene aminotrimethoxysilane) (Dow-Corning Corp.) (0.10 g/m$^2$) from ethanol;

b) a dye-receiving layer of Makrolon 5700 ® (a bisphenol-A polycarbonate) (Bayer AG) (1.6 g/m$^2$), a co-polycarbonate of bisphenol-A and diethylene glycol (1.6 g/m$^2$), diphenyl phthalate (0.32 g/m$^2$), di-n-butyl phthalate (0.32 g/m$^2$), Fluorad FC-431 ® (a fluorinated dispersant) (3M Corp.) (0.011 g/m$^2$) from dichloromethane; and c) a dye receiver overcoat of a linear condensation polymer derived from carbonic acid, bisphenol-A, diethylene glycol, and an aminopropyl-terminated polydimethylsiloxane (49:49:2 mole ratio) (0.22 g/m$^2$), 510 Silicone Fluid (Dow-Corning Corp.) (0.16 g/m$^2$), and Fluorad FC-431 ® (0.032 g/m$^2$) from dichloromethane.

The following samples for whiteness testing were prepared from the above receiver materials by varying the titanium dioxide and optical brightener contents in the upper skin layers (on the side carrying the receiver coatings) as shown in the Table below.

Whiteness measurements were made with a Gretag SPM 50 spectrophotometer. In reading the samples, the illuminant was set for D5000 and the samples were backed by a white support. The whiteness values provided by the above Gretag device are calculated according to the Whiteness Equation recommended by the CIE (Commission Internationale del'Eclairage, CIE Publication No. 15.2 (1986)) which is referenced in *Measuring Colour* by R. W. G. Hunt, John Wiley & Sons, New York, 1987.

Three test sets were run to show the effects of using: 1) different forms of $TiO_2$; 2) different $TiO_2$ coverages; and 3) different optical brighteners. In all tests the optical brightener content was kept at a constant level (0.05 wt. %).

TABLE

| SET # | $TiO_2$ TYPE | COVERAGE ($g/m^2$) | OPTICAL BRIGHTENER | GRETAG WHITENESS |
|---|---|---|---|---|
| 1 | Anatase | 0.65 | Uvitex OBO ®[1] | 99. 04 |
| 1 | Rutile | 0.56 | Uvitex OBO ® | 96.78 |
| 2 | Anatase | 1.05 | Uvitex OBO ® | 97.04 |
| 2 | Rutile | 1.44 | Uvitex OBO ® | 94.42 |
| 3 | Anatase | 0.58 | Hostalux KS ®[2] | 100.57 |
| 3 | Rutile | 0.72 | Hostalux KSO ® | 97.22 |
| 3 | Rutile | 0.68 | Hostalux KSO ® | 97.80 |

[1]Uvitex OB ® (Ciba-Geigy Co.) = 2,2'-bis(5-tert-butyl-2-benzoxazolyl)-thiophene
[2]Hostalux KS ® (Hoechst Celanese Corp.) = a mixture of 4,4'bis(2-benzoxazolyl)-stilbene and 4,4'-bis(5-methyl-2-benzoxazoly)stilbene As is seen from the above data, the whiteness of the receiver material is consistently enhanced when the anatase form of $TiO_2$ is employed along with an optical brightener. A higher coverage of $TiO_2$ with optical brightener shows this same trend (set #2). When a different optical brightener is used (set #3), the superior behavior of the anatase form of titanium dioxide is still evident.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a base having thereon a dye image-receiving layer, the base comprising a composite film laminated to a support, the dye image-receiving layer being on the composite film side of the base, the composite film comprising a microvoided thermoplastic core layer and a substantially void-free thermoplastic surface layer, the thermoplastic surface layer being adjacent to the dye image-receiving layer, and wherein the thermoplastic surface layer contains titanium dioxide in its anatase form and an optical brightener.

2. The element of claim 1 wherein the thickness of the composite film is from 30 to 70 μm.

3. The element of claim 1 wherein the core layer of the composite film comprises from 30 to 85% of the thickness of the composite film.

4. The element of claim 1 wherein the titanium dioxide is present in an amount of from about 0.2 to about 1.5 $g/m^2$ of the thermoplastic surface layer.

5. The element of claim 1 wherein the optical brightener is present in an amount of from about 0.0001 to about 0.01 $g/m^2$ of the thermoplastic surface layer.

6. The element of claim 1 wherein the composite film comprises a microvoided thermoplastic core layer having a substantially void-free thermoplastic surface layer on each side thereof.

7. The element of claim 1 wherein the support comprises synthetic paper.

8. The element of claim 1 wherein the support comprises a non-voided polymer film.

9. The element of claim 1 wherein the support comprises cellulose fiber paper.

10. The element of claim 9 wherein the paper support is from 120 to 250 μm thick and the composite film is from 30 to 50 μm thick.

11. The element of claim 9 further comprising a polyolefin backing layer on the side of the support opposite to the composite film.

12. The element of claim 11 wherein the polyolefin backing layer is present at a coverage of from 30 to 75 $g/m^2$.

13. The element of claim 1 wherein the composite film comprises a microvoided and oriented polypropylene core layer with a surface layer of non-microvoided oriented polypropylene on each side.

14. The element of claim 13 wherein the support is a cellulose fiber paper support from 120 to 250 μm thick and the composite film is from 30 to 50 μm thick.

15. The element of claim 1 wherein the core layer of the composite film comprises a microvoided and oriented thermoplastic polymer and a polymeric void-initiating material.

16. A process of forming a dye transfer image comprising:

a) imagewise-heating a dye-donor element comprising a support having thereon a dye layer comprising a dye dispersed in a binder, and b) transferring a dye image to a dye-receiving element comprising a base having thereon a dye image-receiving layer to form said dye transfer image, wherein the dye-receiving element base comprises a composite film laminated to a support, the dye image-receiving layer being on the composite film side of the base, the composite film comprising a microvoided thermoplastic core layer and at least one substantially void-free thermoplastic surface layer, the thermoplastic surface layer being adjacent to the dye image-receiving layer, and wherein the thermoplastic surface layer contains titanium dioxide in its anatase form and an optical brightener.

17. The process of claim 16 wherein the composite film comprises a microvoided thermoplastic core layer having a substantially void-free thermoplastic surface layer on each side thereof, the thickness of the composite film being from 30 to 70 μm.

18. The process of claim 16 wherein the support comprises cellulose fiber paper from 120 to 250 μm thick and the composite film is from 30 to 50 μm thick and comprises a microvoided and oriented polypropylene core layer with a surface layer of non-microvoided oriented polypropylene on each side.

19. A thermal dye transfer assemblage comprising:

a) a dye-donor element comprising a support having thereon a dye layer comprising a dye dispersed in a binder, and b) a dye-receiving element comprising a support having thereon a dye image-receiving layer, said dye-receiving element being in a superposed relationship with said dye-donor element so that said dye layer is in contact with said dye image-receiving layer, wherein the dye-receiving element base comprises a composite film laminated to a support, the dye image-receiving layer being on the composite film side of the base, the composite film comprising a microvoided thermoplastic core layer and at least one substantially void-free thermoplastic surface layer, the thermoplastic surface layer being adjacent to the dye image-receiving layer, and wherein the thermoplastic surface layer contains titanium dioxide in its anatase form and an optical brightener.

20. The assemblage of claim 19 wherein the thickness of the composite film is from 30 to 70 μm.

* * * * *